US006268838B1

(12) United States Patent
Kim

(10) Patent No.: US 6,268,838 B1
(45) Date of Patent: Jul. 31, 2001

(54) METHOD AND CIRCUIT FOR DRIVING PDP

(75) Inventor: Hwan You Kim, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 08/887,225

(22) Filed: Jul. 2, 1997

(30) Foreign Application Priority Data

Jul. 2, 1996 (KR) ..... 96-26756

(51) Int. Cl.[7] ..... G09G 3/28; G09G 5/10; G09G 3/10

(52) U.S. Cl. ..... 345/63; 345/147; 315/169.4

(58) Field of Search ..... 345/60, 63, 67, 345/68, 76, 147, 148, 213, 72, 203, 509, 515, 88, 89, 153; 315/169.4, 169.1

(56) References Cited

U.S. PATENT DOCUMENTS 3,863,023 * 1/1975 Schmersal et al. ..... 315/169.4
4,006,298 * 2/1977 Fowler et al. ..... 345/147
4,183,062 * 1/1980 Weisbrod ..... 345/60
4,385,293 * 5/1983 Wisnieff ..... 345/63
4,672,357 * 6/1987 Lorteije et al. ..... 345/147
5,420,602 * 5/1995 Kanazawa ..... 345/67
5,436,634 * 7/1995 Kanazawa ..... 345/60
5,446,344 8/1995 Kanazawa ..... 315/169.4
5,530,457 * 6/1996 Helgeson ..... 345/507
5,541,618 * 7/1996 Shinoda ..... 345/60
5,652,600 * 7/1997 Khormaei et al. ..... 345/76
5,724,054 * 3/1998 Shinoda ..... 345/60
5,731,802 * 3/1998 Aras et al. ..... 345/148
5,742,265 * 4/1998 Stoller et al. ..... 345/60
5,767,828 * 6/1998 McKnight ..... 345/89
5,818,419 * 10/1998 Tajima et al. ..... 345/63
5,835,072 * 11/1998 Kanazawa ..... 345/60
5,969,710 * 10/1999 Doherty et al. ..... 345/148
5,986,640 * 11/1999 Baldwin et al. ..... 345/147
6,025,818 * 2/2000 Okano ..... 345/63

* cited by examiner

*Primary Examiner*—Steven Saras
*Assistant Examiner*—Paul A. Bell

(57) ABSTRACT

A method and a circuit for driving a plasma display panel (PDP) in which an input image data is processed with a minimum block unit so as to realize 256 gray levels are disclosed, the circuit including an input data converter for converting an image data inputted externally into a gradation data of N bits; a first data storing part for storing the converted gradation data of N bits by M pixels; a data divider for dividing the gradation data stored in the first data storing part into predetermined bits that are from MSB to LSB; a second data storing part for storing the gradation data divided into the predetermined bits; and a controller 16 for controlling inputs and outputs of data of the first and second data storing parts, and the data divider.

12 Claims, 4 Drawing Sheets

METHOD AND CIRCUIT FOR DRIVING PDP

BACKGROUND OF THE INVENTION

1. Field of the Invention

The present invention relates to a plasma display apparatus and, more particularly, to a method and a circuit for driving a plasma display panel (PDP) in which an input image data is processed with a minimum block unit so as to realize 256 gray levels.

2. Discussion of the Related Art

Conventionally, a PDP is discharged by adjusting a voltage applied to between vertical and horizontal electrodes of a cell, and an amount of discharged light is adjustable by varying a discharging time within each cell.

The entire screen of a PDP is obtained operating in matrix by applying a light pulse for inputting an image signal into vertical and horizontal electrode of each cell, a scan pulse for scanning, a sustain pulse for maintaining discharge, and an erase pulse for stopping the discharge of the discharged cell.

Gradation of brightness (gray levels) required for image display is obtained by varying a discharging time of each cell within a period required for displaying an entire image (1/30 second as for NTSC TV). A luminance of a screen is determined by a brightness which is made when each cell is operated at its maximum. A driving circuit must be designed to maintain a discharging time of a cell as long as possible within a time allowed for constituting a screen, so as to increase its luminance.

FIG. 1 is a block diagram of a general PDP driving circuit illustrated in U.S. Pat. No. 5,446,344. The PDP driving circuit includes a glass substrate where scan electrodes and common electrodes are formed and a panel 1 formed by vacuum connection of a rear glass substrate where an addressing electrode is formed, an addressing electrode driver 4 for applying a digital image data to the addressing electrode formed on the rear glass substrate, a scan driver 3 for applying a scan pulse for determining whether the panel 1 is driven or not, a common electrode driver 5 for driving the common electrode of the panel 1, and a controller 2 for providing signals and data necessary for driving the drivers 3, 4, and 5.

The controller 2 in such a PDP having the aforementioned structure is provided with various signals, such as clock signals, RGB data, vertical and horizontal synchronizing signals Vsync and Hsync. Subsequently, the controller 2 applies scan data and control data into the scan driver 3 and address data and address clock signals into the addressing electrode driver 4. The scan electrode and the common electrode are driven according to the signals applied into each of the drivers, and then data supplied to the addressing electrodes can be displayable on the panel 1.

A sub-field method and a sub-frame method, which are methods for driving a PDP, will be described.

In sub-field method, a frame is divided into X number of sub-fields, thus realizing $2^X$ number of gray levels. Since each sub-field corresponds to a luminance value in proportion to a luminance relative ratio of 1:2:4:8:16:32:64:128, combination of several sub-fields serves to display a pixel corresponding to a gradation data (0~($2^x$−1). For example, as shown in FIG. 2, after a frame is divided into 8 sub-fields $SF_1$–$SF_8$, each of the sub-fields $SF_1$–$SF_8$ is made to correspond to a luminance value in proportion to a ratio of 1:2:4:8:16:32:64:128 so that a combination of several sub-fields can serve to display a pixel corresponding to d gradation data 0~255 (usually displayed as 8 bit $D_7$~$D_0$). As a result, 256 gray levels can be realized.

That is to say, $D_0$ bit gradation data, an LSB among gradation data of each cell, is provided for each cell on driving a first sub-field $SF_1$, and $D_1$, $D_2$, $D_3$, $D_4$, $D_5$, $D_6$, $D_7$, bit gradation data are provided for corresponding cells on driving second, third, fourth, fifth, sixth, seventh, and eighth sub-fields $SF_2$–$SF_8$, respectively. Accordingly, a specific cell is luminated and discharge of the specific cell is maintained for a predetermined time for each of the sub-fields $SF_1$–$SF_8$, thus displaying a pixel.

However, in the sub-field driving method, since a gradation data of an identical bit corresponding to each sub-field is provided for each cell, it is easy to obtain a gradation data, but since a entire cell corresponding to each sub-field can be erasable and dischargeable, a picture flicker is caused.

In order to solve the aforementioned problem, a sub-frame driving method has been proposed. In this method, a frame is divided into X number of sub-frames to obtain $2^X$ number of gray levels. Each of the sub-frames includes lines of as many as a number in proportion to a luminance relative ratio 1:2:4:8:16: . . . . For example, as shown in FIG. 3, each of 8 sub-frames $sf_1$–$sf_8$, which a frame has been divided into, has lines of as many as a corresponding number in proportion to the ratio of 1:2:4:8:16:32:64:128. Every other 8 lines are being scanned repeatedly at a time until the total lines are scanned 8 times such that pixels corresponding to gradation data 0–256 can be displayed, thus realizing 256 gray levels.

That is to say, if a frame is divided into 8 sub-frames $sf_1$–$sf^8$, when a number of total lines is 255, first, second, third, fourth, fifth, sixth, seventh, and eighth sub-frames $sf_1$–$sf_8$, have a 255th line (total one line), 254th line to 253rd line (total 2 lines), 252nd line to 249th line (total 4 lines), 248th line to 241st line (total 8 lines), 240th line to 225 line (total 16 lines), 224th line to 193 line (total 32 lines), 192nd line to 129th line (total 64 lines), and 128th line to 1st line (total 128 lines), respectively.

The first lines (the 255th line, 253rd line, 249th line, 241st line, 225th line, 193rd line, 129th line, and 1st line) corresponding to the eight sub-frames $sf_1$–$sf_8$, respectively, are sequentially scanned at a time with gradation data of bit corresponding to the above mentioned lines provided. Then, discharge erase of entire lines is carried out.

Next, another eight lines following the scanned eight lines are sequentially scanned at a time as shown in the following table and a gradation data of bit corresponding to each line is provided. Thereafter, discharge erase is repeatedly carried out over the entire lines, thereby realizing 256 gray levels.

| order | $sf_1$ | $sf_2$ | $sf_3$ | $sf_4$ | $sf_5$ | $sf_6$ | $sf_7$ | $sf_8$ |
|---|---|---|---|---|---|---|---|---|
| 1 | 255 | 253 | 249 | 241 | 225 | 193 | 129 | 1 |
| 2 | 1 | 254 | 250 | 242 | 226 | 194 | 130 | 2 |
| 3 | 2 | 255 | 251 | 243 | 227 | 195 | 131 | 3 |
| 4 | 3 | 1 | 252 | 244 | 228 | 196 | 132 | 4 |
| 5 | 4 | 2 | 253 | 245 | 229 | 197 | 133 | 5 |
| 6 | 5 | 3 | 254 | 246 | 230 | 198 | 134 | 6 |
| . | . | . | . | . | . | . | . | . |
| . | . | . | . | . | . | . | . | . |
| . | . | . | . | . | . | . | . | . |
| 250 | 249 | 247 | 243 | 235 | 219 | 187 | 123 | 250 |
| 251 | 250 | 248 | 244 | 236 | 220 | 188 | 124 | 251 |
| 252 | 251 | 249 | 245 | 237 | 221 | 189 | 125 | 252 |
| 253 | 252 | 250 | 246 | 238 | 222 | 190 | 126 | 253 |
| 254 | 253 | 251 | 247 | 239 | 223 | 191 | 127 | 254 |
| 255 | 254 | 252 | 248 | 240 | 224 | 192 | 128 | 255 |

For example, the first lines of all sub-frames $sf_8$, $sf_1$, $sf_2$, $sf_3$, $sf_4$, $sf_5$, $sf_6$, and $sf_7$, are scanned at the 1st, 2nd, 4th, 8th, 16th, 32nd, 64th, and 128th sequences, respectively, thereby providing gradation data. A gradation data provided at the first sequence is sustained one until another gradation data is provided at the second sequence. In the same way, the gradation data provided at the 2nd sequence is sustained twice until another gradation data is provided at the fourth sequence. Accordingly, gradation data provided at the 1st, 2nd, 4th, 8th, 16th, 32nd, 64th, and 128th sequences are sustained once, twice, four times, eight times, sixteen times, thirty two times, sixty four times, one hundred twenty eight times, respectively. That is to say, at the first sequence, a gradation data of least significant bit (LSB) $D_0$ is provided for the first line. In the same way, at the 2nd, 4th, 8th, 16th, 32nd, 64th, and 128th sequences, gradation data of bits $D_1$, $D_2$, $D_3$, $D_4$, $D_5$, $D_6$, $D_7$ should be provided for the first lines.

Besides the first lines, a gradation data of a corresponding bit should be provided for every line according to a corresponding sustaining time. For example, 1st, 254th, 250th, 242nd,, 226th, 194th, 130th, and 2nd lines should be provided with gradation data of $D_1$, $D_2$, $D_3$, $D_4$, $D_5$, $D_6$, $D_7$, $D_0$ bits, respectively.

It is very complex and takes too much time to realize gradation data by utilizing the previously described sub-frame driving method. Accordingly, much development and research has been directed to real time processing of image data

SUMMARY OF THE INVENTION

Therefore, the present invention is directed to a method and a circuit for driving a PDP that substantially obviate one or more of problems due to limitations and disadvantages of the related art.

An object of the invention is to provide a method and a circuit for driving a PDP in which an externally input image data is processed by a minimum block unit so as to output at a high speed a gradation data of a bit to each cell according to a PDP-driving method, thereby accomplishing real time processing of image data.

Additional features and advantages of the invention will be set forth in the description which follows and in part will be apparent from the description, or may be learned by practice of the invention. The objectives and other advantages of the invention will be realized add attained by the structure particularly pointed out in the written description and claims hereof as well as the appended drawings.

To achieve these and other advantages and in accordance with the purpose of the present invention, as embodied and broadly described, the circuit for driving a PDP is characterized in that an image data is divided by M pixels to be predetermined bits and a gradation data of each bit is outputted to each cell.

In another aspect of the present invention, a method for driving a PDP is characterized in that an image data is converted into a gradation data of 8 bits and then the converted gradation data is divided by 8 pixels to be predetermined bits.

It is to be understood that both the foregoing general description and the following detailed description are exemplary and explanatory and are intended to provide further explanation of the invention as claimed.

BRIEF DESCRIPTION OF THE DRAWINGS

These and various other objects, features, and advantages of the present invention will be readily understood with reference to the following detailed description read in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
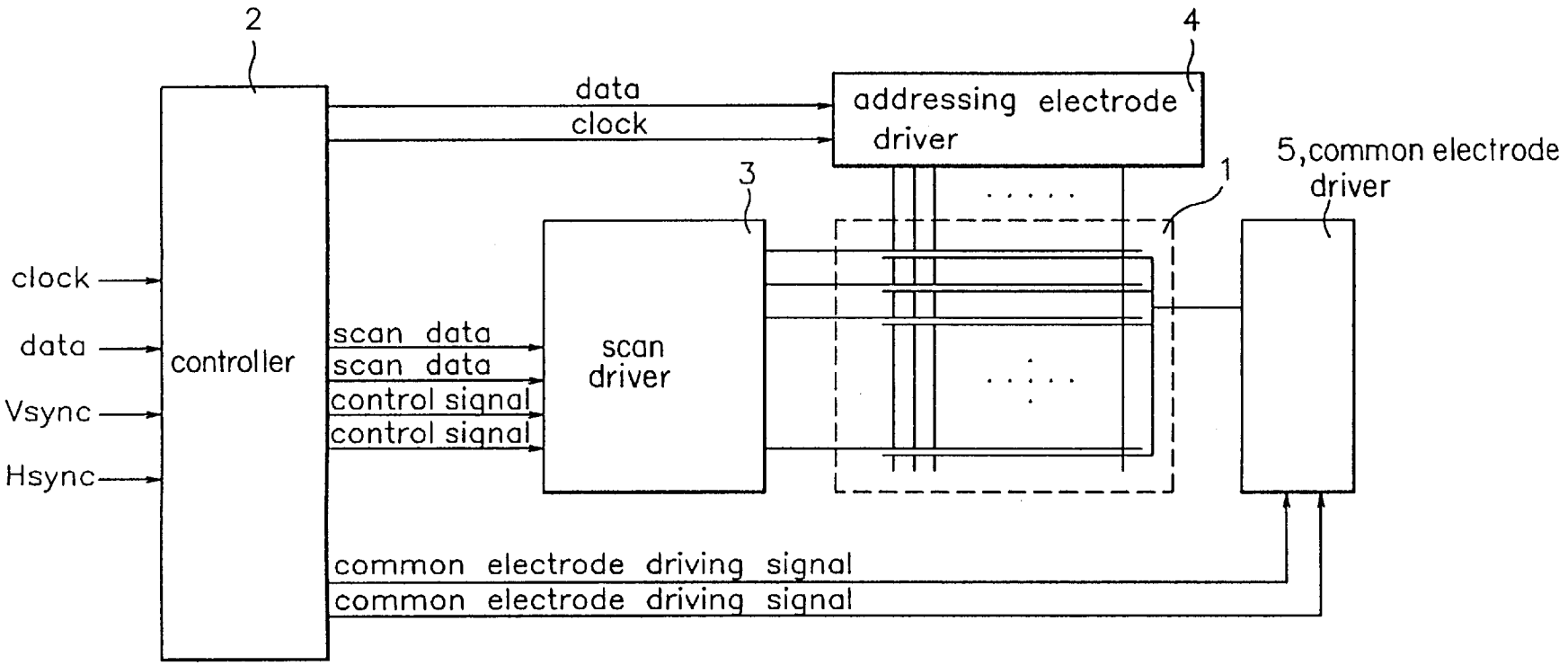
FIG. 1 prior art
FIG. 1 is a cross-sectional view of a general PDP.
Figure 2:
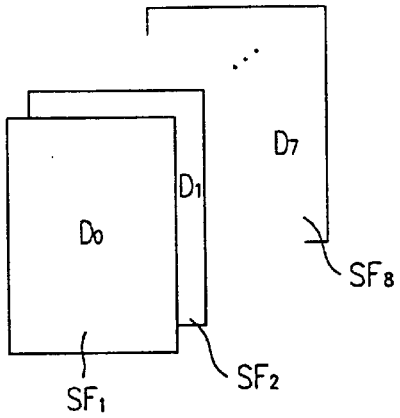
FIG.2 prior art
FIG. 2 shows a concept of a sub-field driving method for realizing 256 gray levels.
Figure 3:
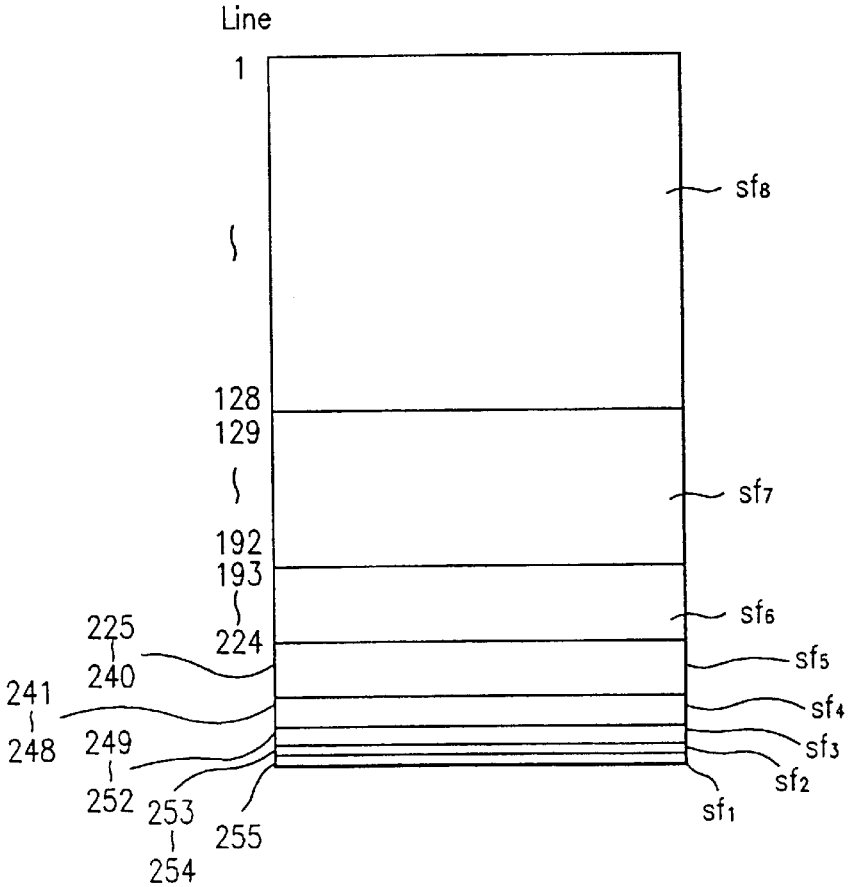
FIG.3 prior art
FIG. 3 shows a concept of a sub-frame driving method for realizing 256 gray levels.
Figure 4:
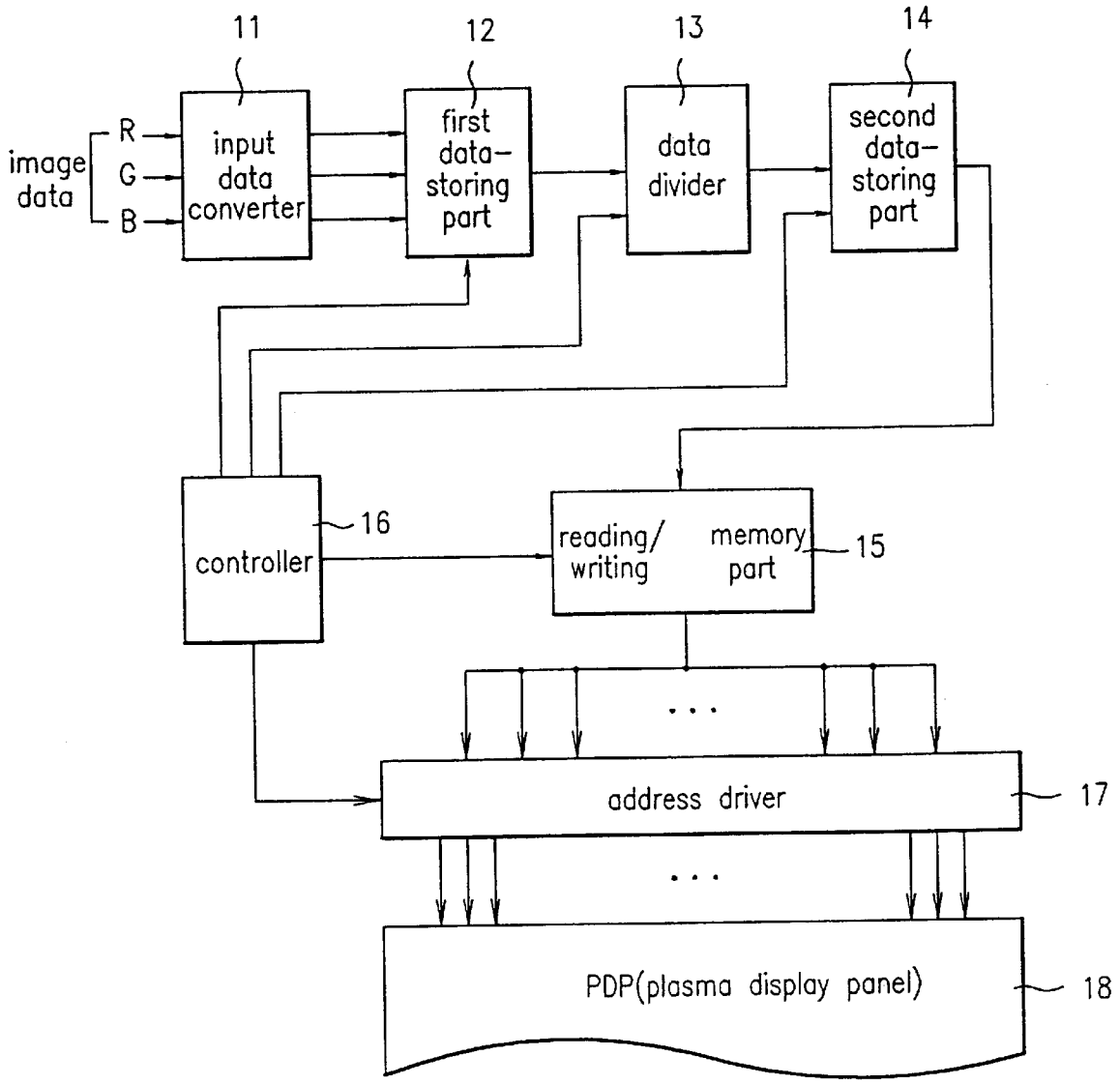
FIG. 4 is a block diagram of a circuit for driving a PDP according to the present invention.

FIG. 4 is a block diagram of a circuit for driving a PDP according to the present invention. As shown in FIG. 4, a PDP-driving circuit for realizing 256 gray levels includes an input data converter 11 for converting Red (R), Green(G), and B(Blue) image data, into R, G, and B gradation data having 8 bits; a first data storing part 12 for storing each of the R, G, and B gradation data of 8 bits by 8 pixels; a data divider 13 for dividing each of the stored R, G, and B gradation data in the first data-storing part 12 into predetermined bits that are from MSB to LSB; a second data storing part 14 for storing each of the R, G, and B gradation data divided into the predetermined bits; a memory 15 for reading each of R, G, and B gradation data corresponding to the predetermined bits, recording each of them on a corresponding address, recording each of the R, G, and B gradation data of corresponding bits of each field in a line-scanning order of a sub-frame mode, or in a sub-field mode for outputting; a controller 16 for controlling inputs and outputs of the first and second data storing parts 12 and 14, the data divider 13, and the memory 15.

The first data-storing part 12 includes 24 ( i.e., 8 pixels× 3(R, G, B)=24) shift resisters of 8 bits for storing R, G, and B gradation data of 8 pixels.

Figure 5:
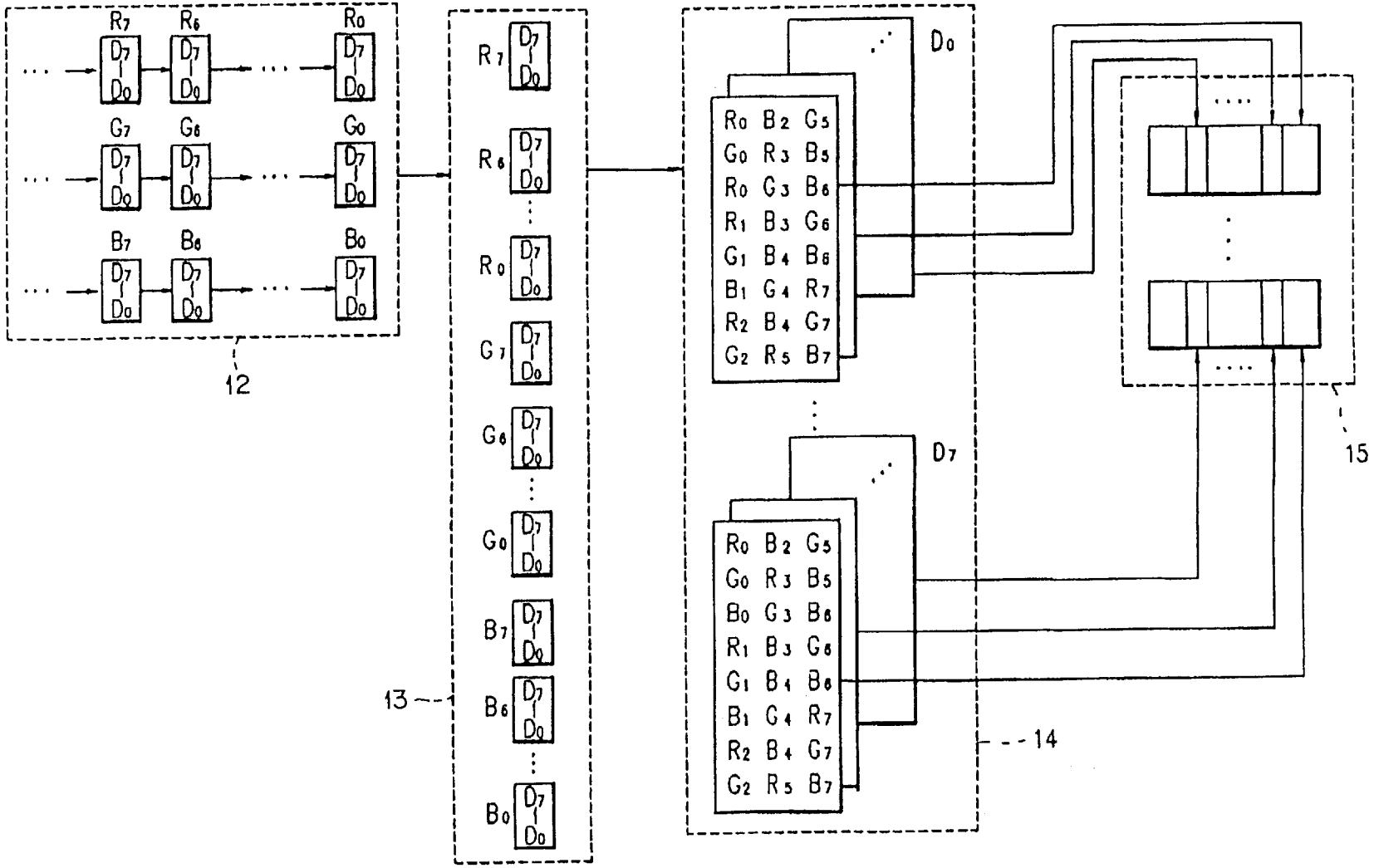
FIG. 5 shows a process of realizing gradation data of corresponding bit of FIG. 4 according to the present invention.

A method for realizing gradation data will be described with reference to FIGS. 4 and 5.

An input data converter 11 digitalizes R, G, and B analog image data to convert them into R, G, and B gradation data ($D_7$–$D_0$) of 8 bits, respectively, for outputting the converted data into the a first data storing part 12.

Next, the R, G, and B gradation data $D_7$–$D_0$ of 8 bits inputted from the input data converter 11 are sequentially stored in the first data storing part 12 in a unit of 8 pixels $R_0$–$R_7$, $G_0$–$G_7$, and $B_0$–$B_7$. Subsequently, a data divider 13 divides each of the R, G, and B gradation data of 8 pixels stored in the first data storing part 12 into from MSB $D_7$ to LSB $D_0$ under the control of a controller 16 and outputs them into a second data storing part 14. Then the divided data are stored in the second data storing part 14. The previously described process steps are carried out repeatedly.

Thereafter, according to a record control signal READ of the controller 16, a memory 15 reads the R, G, and B gradation data of each bit stored in the second data storing part 14 and records them in a corresponding addresses. Recording each of the R, G, and B gradation data of each bit in a corresponding address according to a record control signal READ of the controller 16, the memory 15 reads the R, G, and B gradation data of corresponding bits of first lines among the R, G, and B gradation data of bits recorded in the memory 15 and outputs them according to a read control signal WRITE or a line scanning signal of the controller 16.

Next, an address driver 17 of a plasma display apparatus latches the R, G, and B gradation data of bits for first lines outputted from the memory 15 under the control of the controller 16 and then provides the data to address electrode lines of a PDP 18 at the same time as scanning.

In the PDP-driving method, since a gradation data of each bit required are recorded in its corresponding address in the memory 15, the gradation data of a corresponding bit can be outputted according to a scanned line in a short time by searching addresses of the memory 15.

As described previously, since an image data inputted externally is processed by a minimum block unit, it is easy to process gradation data of bits at a high speed required for a sub-frame or sub-field method, thereby enabling a real time processing of image data. Further, since an image data is processed by a 8 pixel unit on realizing 256 gray levels, it is possible to realize gradation data of all bits, thereby enabling to process an image data initially inputted as a clock of about 20–30 Mhz at a high speed and accomplishing the real time processing.

It will be apparent to those skilled in the art that various modification and variations can be made in the method and circuit for driving a PDP of the present invention without departing from the spirit or scope of the inventions. Thus, it is intended that the present invention cover the modifications and variations of this invention provided they come within the scope of the appended claims and their equivalents.

What is claimed is:

1. A circuit for driving a plasma display panel, comprising:

an input data converter for converting an inputted pixel data into a gray scale data which is an N-bit digital data having a $2^N$ gray level, where N is an integer;

a first data storing part for storing the converted gray scale data by M pixels where M is an integer;

a data divider for dividing the stored gray scale data into respective bit data corresponding to each bit position of the N-bits; and a second data storing part for storing the divided bit data by grouping bit data having an identical bit position from the data divider.

2. The circuit as claimed in claim 1, wherein the input data converter converts the pixel data into the digital data of 8 bits for realizing 256 gray levels.

3. The circuit as claimed in claim 1, wherein the first data storing part stores the N-bit digital data of 8 pixels for convenience of parallel processing of digital data.

4. The circuit as claimed in claim 1, further comprising:

a controller which divides a frame into X number of sub-frames, where X is an integer, and entire lines of each sub-frame are scanned X number of times and provides an output data of bits corresponding to each line, and then discharge and erase over entire lines are carried out repeatedly.

5. The circuit as claimed in claim 1, further comprising:

a controller which divides a frame into X number of sub-fields and provides an identical data of N bits of each sub-field for each cell and then controls discharge conditions of a specific cell.

6. The circuit as claimed in claim 1, wherein a predetermined bit ordering is from most significant bit to least significant bit.

7. A method for driving a plasma display panel comprising:

(a) converting an inputted pixel data into a gray scale data which is an N-bit digital data having a $2^N$ gray level, where N is an integer;

storing the gray scale data;

(b) dividing stored gray scale data into respective bit data corresponding to each bit position of the N-bits and then re-storing divided bit data by grouping bit data having an identical bit position; and (c) reading and outputting re-stored data.

8. The method as claimed in claim 7, wherein the gray scale data is composed of 8 bits to realize 256 gray levels.

9. The method as claimed in claim 7, wherein the gray scale data is processed by 8 pixels for convenience of parallel processing.

10. The method as claimed in claim 7, wherein, in step (c), a frame is divided into X number of sub-frames, where X is an integer, and entire lines of each sub-frame are scanned X number of times and provides the gray scale data of a bit corresponding to each line for each cell, and then discharge and erase are carried out repeatedly over the entire lines.

11. The method as claimed in claim 7, wherein, in step (c), a frame is divided into X number of sub-fields and provides an identical gray scale data of N bits of each sub-field for each cell, and then discharge of a specific cell is sustained.

12. A circuit for driving a plasma display panel, comprising:

an input data converter for converting an inputted pixel data into a gray scale data which is an N-bit digital data having a $2^N$ gray level, where N is an integer;

a first data storing part for storing the converted gray scale data by M pixels where M is an integer;

a data divider for dividing the stored gray scale data into respective bit data corresponding to each bit position of the N-bits;

a second data storing part for storing the divided bit data by grouping bit data having an identical bit position from the data divider; and a memory for reading and storing the grouped bit data from the second data storing part into corresponding addresses within the memory.

* * * * *